US008556138B2

(12) United States Patent
Mainetti

(10) Patent No.: US 8,556,138 B2
(45) Date of Patent: Oct. 15, 2013

(54) CROWN-TYPE SIZER FOR A HANGER

(75) Inventor: Mario Mainetti, Valdagno (IT)

(73) Assignee: Mainetti S.p.A., Castelgomberto (Vicenza) (IT)

( * ) Notice: Subject to any disclaimer, the term of this patent is extended or adjusted under 35 U.S.C. 154(b) by 0 days.

(21) Appl. No.: 13/402,183

(22) Filed: Feb. 22, 2012

(65) Prior Publication Data

US 2012/0181309 A1 Jul. 19, 2012

Related U.S. Application Data

(63) Continuation of application No. 12/586,253, filed on Sep. 18, 2009, now Pat. No. 8,141,756.

(30) Foreign Application Priority Data

Apr. 27, 2009 (IT) ..... VI2009A0091

(51) Int. Cl.
*A41D 27/22* (2006.01)

(52) U.S. Cl.
USPC ..... 223/85; 40/322

(58) Field of Classification Search
USPC ..... 223/85, 88, 92; 40/322
See application file for complete search history.

(56) References Cited

U.S. PATENT DOCUMENTS 4,198,773 A 4/1980 Batts et al.
4,322,902 A * 4/1982 Lenthall ..... 40/322
4,881,836 A 11/1989 Blanchard
5,503,310 A * 4/1996 Zuckerman et al. ..... 223/85
6,145,713 A 11/2000 Zuckerman
D510,198 S 10/2005 Willardson
D528,807 S 9/2006 Mainetti
7,240,813 B1 7/2007 Goldman
7,287,674 B1 10/2007 Sutton et al.

(Continued)

FOREIGN PATENT DOCUMENTS

AU 49049/85 5/1986

OTHER PUBLICATIONS

European Search Report dated Apr. 29, 2010, from corresponding Italian Application No. ITVI20090091.

(Continued)

*Primary Examiner* — Nathan Durham

(74) *Attorney, Agent, or Firm* — Katten Muchin Rosenman LLP

(57) ABSTRACT

A crown-type sizer is suitable for mounting on a hanger having a body and a hook extending from a mid-point of the body and includes a peripheral wall having a first side and a second side opposed to the first side. The sizer includes a quantity of bosses that have at least one boss in a first set and at least one boss in a second set. The first set is disposed on the first side and the second set is disposed on the second side. Each of the bosses engages onto the hanger and block the sizer onto the hanger in a stable manner. The first set of bosses is offset to the second set of bosses with respect to a plane bisecting the first and the second side.

6 Claims, 7 Drawing Sheets

(56) References Cited

U.S. PATENT DOCUMENTS

| | | | |
|---|---|---|---|
| 7,303,101 | B2 | 12/2007 | Goldman |
| 7,628,301 | B2 | 12/2009 | Goldman et al. |
| 2006/0006204 | A1 | 1/2006 | Mainetti |
| 2006/0213938 | A1 | 9/2006 | Gouldson |
| 2007/0062984 | A1 | 3/2007 | Louw |
| 2007/0199963 | A1 | 8/2007 | Gouldson |
| 2008/0054029 | A1 | 3/2008 | Ho |
| 2009/0120973 | A1 | 5/2009 | Ho |
| 2009/0294492 | A1 | 12/2009 | Goldman et al. |
| 2010/0237109 | A1 | 9/2010 | Gouldson |

OTHER PUBLICATIONS

European Written Opinion dated Apr. 27, 2009, from corresponding Italian Application No. ITVI20090091.

United States Office Action dated Mar. 28, 2011, from corresponding U.S. Appl. No. 12/586,253.

United States Office Action dated Sep. 14, 2011, from corresponding U.S. Appl. No. 12/586,253.

* cited by examiner

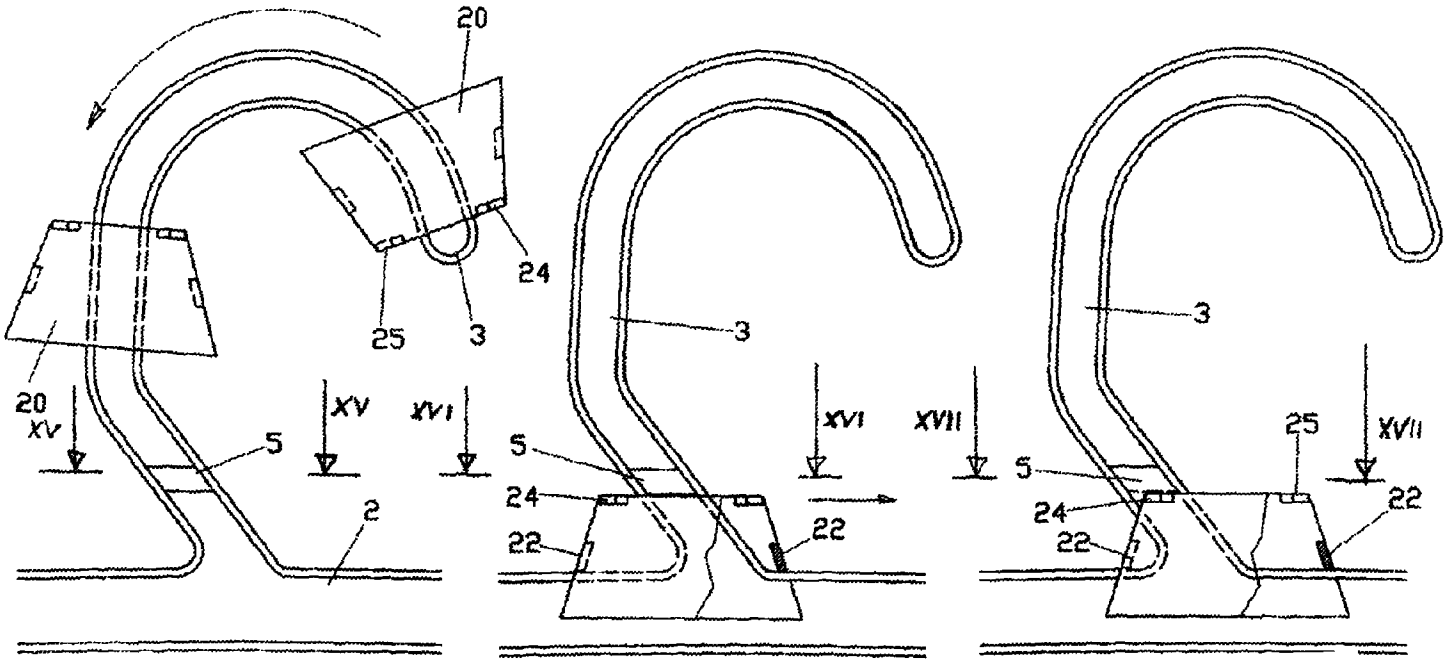
FIG. 15
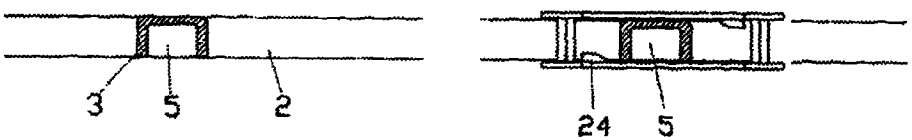
FIG. 15A
FIG. 16
FIG. 16A
FIG. 17
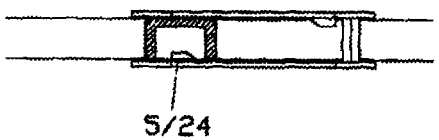
FIG. 17A

CROWN-TYPE SIZER FOR A HANGER

CROSS-REFERENCE TO RELATED APPLICATIONS

This application is a continuation of and claims priority to U.S. Ser. No. 12/586,253 filed Sep. 18, 2009, which is pending and which is hereby incorporated by reference in its entirety for all purposes.

U.S. Ser. No. 12/586,253 claims priority to Italian Application VI2009A000091 filed Apr. 27, 2009, which is hereby incorporated by reference in its entirety for all purposes.

BACKGROUND OF THE INVENTION

1. Field of the Invention

This invention relates to a crown-type sizer to be mounted onto a hanger. More particularly, this invention relates to the combination of a hanger, preferably for underwear, lingerie and similar items, with a crown-type sizer.

2. Description of the Related Art

The use of crown-type sizers is particularly widespread in many sectors, in particular in the large-scale retail trade to identify the products on sale.

In the current state of the art, many known crown sizers have the drawback of being easily detachable from their positioning seat. Such easy removal involves the risk of hangers having missing crown sizers and therefore the risk of having some products exchanged with others by ill-intentioned people during warehouse management or in the stores where the goods are on sale. This negative circumstance can happen in particular when the crown sizer is applied onto clothes hangers for garment size identification marking.

Moreover, since the clothes hangers are normally present in domestic environments, a further risk exists that, since the sizers can be attractive to children due to their reduced size and to their color, they can in particular be mistaken for candy and thus be swallowed, precisely because they are easily detachable.

In the state of art, such as shown in U.S. Design Pat. No. D528,807, in order to prevent such negative possibilities, crown-type sizers have been devised, which are assembled onto a hanger in an integral manner, making them much more difficult to detach and remove; moreover, the possible removal compromises the integrity of the support to the point of making re-use of the hanger for different sized garments impossible.

U.S. Pat. No. 7,240,813 and U.S. Design Pat. No. D510,198 as well as published US 2006/006204 describe examples of crown-type sizers for use with hangers having a metal hook that extends perpendicularly from a clothes hanger body. However, these sizers can not easily be applied onto a hanger made entirely from plastic, as far as the body as well as the hook are concerned, as the hook extends at an angle other than 90.degree. with respect to the body, before taking on the rounded shape of the hook itself.

SUMMARY OF THE INVENTION

Accordingly, it is an object of the invention to provide a crown-type sizer for use on hangers for garments, which can be positioned in a corresponding seat so that the sizer becomes very resistant to possible removal attempts.

It is another object of the invention to provide a crown-type sizer that can be applied onto a hanger entirely made from plastic and which has a plastic hook which extends from a body of the clothes hanger at an angle other than 90.degree.

It is another object of the invention to provide a crown-type sizer for hangers, which is aesthetically pleasing when is applied onto a plastic hanger.

Briefly, the invention provides a crown-type sizer that can be applied onto a plastic hanger having a body and an integral hook extending upwards from the body itself, which consists of a peripheral wall which defines an open base at a bottom end and an open base in the upper part to allow the sizer to pass over the hanger hook.

Moreover, on one of the walls of the sizer there is at least one protrusion boss for engaging the sizer onto the hanger and to ensure that the sizer remains blocked on the hanger itself.

Specifically, the peripheral wall of the sizer includes a pair of, preferably trapezium-shaped, longitudinal sides and a pair of, preferably rectangle-shaped, transverse sides, to form a prism-shaped encasing structure with both bases open and thus to form a sizer which is different and opposite the so called "side" sizer or the classic sizer inserted from the top, as known in the state of art.

Moreover, the longitudinal sides of the peripheral wall have a greater height than that of the transverse sides so as to form a recess or undercut suitable for receiving the body of the hanger; all of this imparts stability to the sizer with respect to the possibility of twisting on the hook of the hanger.

In a preferred embodiment, the hook of the hanger has a groove or cavity that extends along one side and a protrusion inside the groove, whereas the sizer has a protrusion boss on each of the two opposite sides of the peripheral wall to selectively lock into the groove and for engaging with and under the protrusion in the groove to secure the sizer onto the hanger. The presence of the double protrusions on the two sides of the peripheral wall allows the sizer to be placed over the end part of the hook of a hanger that can be indifferently oriented in either one of two possible directions.

In the embodiment in which the hook of the hanger extends from the body of the hanger by an angle other than 90.degree. before taking on the shape of a hook, the protrusion bosses on the peripheral wall allow the sizer to correctly "fit" the hanger, being kept in the correct position by the protrusion located inside the groove of the hook of the hanger.

Moreover, the hook of the hanger is tapered at the free end part so that the free end part of the hook has a thickness which is smaller than the space between a protrusion boss and the opposite side of the peripheral wall of the sizer.

In this embodiment, in order to be able to mount the sizer onto a hanger, the aforementioned sizer is positioned above the tapered end part of the hook and then moved along the hook itself. As the sizer moves along the hook, a protrusion boss of the sizer enters into the groove located on the hook thereby limiting the side-to-side movement of the sizer with respect to the hook.

Continued movement of the sizer brings the protrusion boss on the sizer into abutment with the protrusion of the hook. At that time, the sizer is forced toward the body of the hanger to allow the protrusion boss of the sizer to snap under the protrusion in the groove of the hook, with a "click", typical of a snap-in locking.

In order to facilitate such an operation, each protrusion boss on the sizer is tapered to facilitate the sliding above the protrusion of the hook towards the body of the hanger and, at the same time, to resist a reverse movement, which must be activated in order to detach the sizer from the hook.

The dimensions of the sizer and of the hanger are such that when a protrusion boss of the sizer snaps-in under the protrusion located in the groove of the hook, the rectangular transverse sides of the peripheral wall of the sizer come to rest on the cross bar of the hanger, arranged in the recess defined in the upper part of the sizer.

Moreover, the upper surface of each protrusion boss of the sizer is flat, as well as perpendicular to the plane of the peripheral wall of the sizer and is therefore opposite the surface of the protrusion on the hook of the hanger. This blocks the sizer from coming off the body of the hanger after having being applied through the aforementioned snap-in operation.

The sizer is particularly useful on a plastic hanger having a hook which extends in a direction opposite the body with an angle other than 90.degree., before taking on the typical hook shape. With such a configuration of the hook, the width of the sizer must be significantly greater than the width of the filiform body which forms the hook, so as to form a space inside of which the hook can extend, with its particular angle. Such a considerable width of the sizer provides a relatively large area for size indicia or other advertising script on the longitudinal walls.

Finally, the offset and asymmetric arrangement of the protrusion bosses inside the sizer allows the sizer to be positioned on the body of the hanger from the moment in which the sizer engages under the protrusion located in the groove of the hook which is arranged laterally with respect to the point in which the hook merges with the body of the hanger.

In another embodiment, a sizer is provided where the protrusion bosses are spaced apart at a greater distance than the width of the hook of a hanger so that when the sizer is initially slid over the hook, the protrusion bosses are disposed outside of the hook. Once the sizer is seated onto the hanger body, the sizer is slid laterally, i.e. sideways, to slide one or the other of the protrusion bosses into the groove of the hanger hook and under the protrusion of the hook thereby snapping the sizer into place.

In a third embodiment, a sizer is provided that can be slid onto a hook of a hanger and blocked in place as in the first embodiment or that can be slid onto a hook of a hanger and laterally moved into place as in the second embodiment.

BRIEF DESCRIPTION OF THE DRAWINGS

These and other objects and advantages of the invention will become more apparent from the following detailed description taken in conjunction with the accompanying drawings in which:

FIG. 15 schematically illustrates the manner of sliding the sizer of FIG. 8 onto a hanger hook in accordance with the invention;

FIG. 15A illustrates a view taken on line XV-XV of FIG. 15;

FIG. 16 illustrates the position of the sizer of FIG. 8 on the hanger immediately prior to snapping into place;

FIG. 16A illustrates a view taken on line XVI-XVI of FIG. 16;

FIG. 17 illustrates the position of the sizer of FIG. 8 on the hanger after being snapped into place in accordance with the invention;

FIG. 17A illustrates a view taken on line XVII-XVII of FIG. 17; and the position of the sizer of FIG. 8 on the hanger immediately prior to snapping into place.

DETAILED DESCRIPTION OF THE INVENTION

Figure 2:
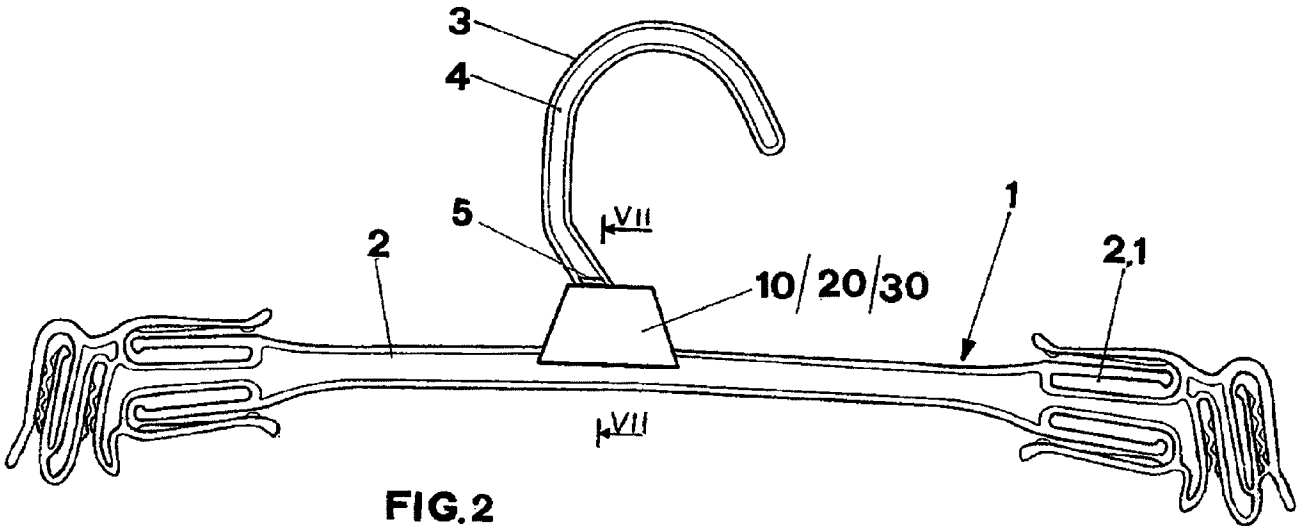
FIG. 2 illustrates a front view of the hanger of FIG. 1 with a crown sizer in accordance with the invention in place.
Figure 1:
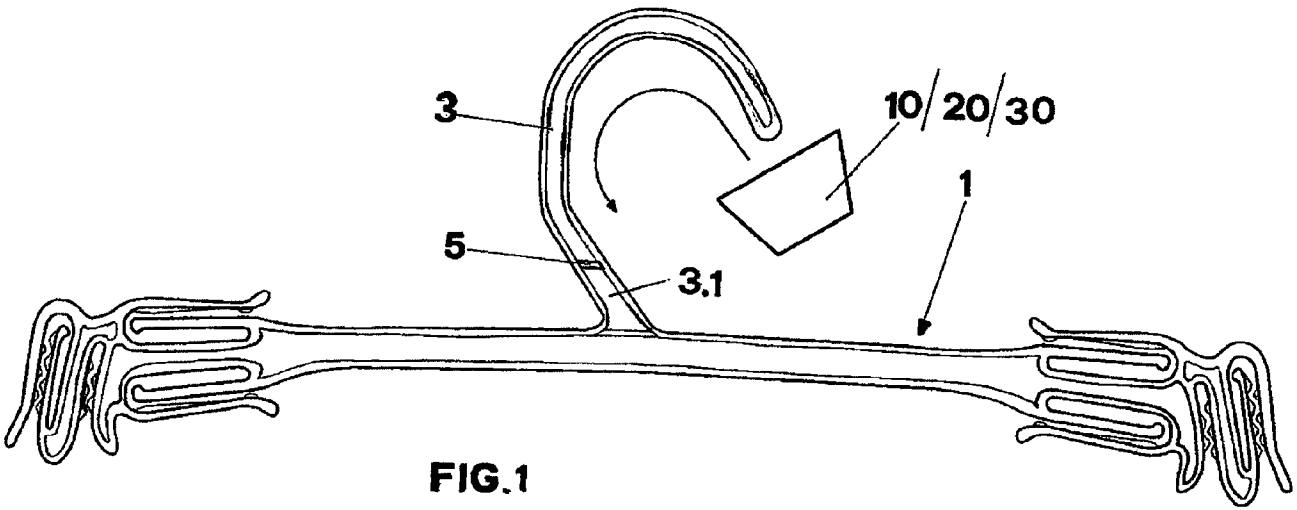
FIG. 1 illustrates a front view of a hanger at the time a crown sizer in accordance with the invention is to be mounted on the hook thereof.

As can be seen in FIGS. 1 and 2, the hanger 1 consists of a monolithic structure of an item made from plastic suitable for its purpose including a body 2, equipped at the two ends with a clip structure 2.1, suitable for holding one or more lingerie, underwear and similar clothing items, and a hook 3, which extends upwards from the mid-point of the body 2 and with a lower portion 3.1 oriented with an angle to the body 2 which is less than 90.degree.

The hook 3 has a rear portion which is smooth and coplanar with the rear part of the body 2 and a front part where there is a channel-shaped groove 4, which extends for the entire longitudinal length of the hook 3. The groove also extends for the entire length of the body 2.

Figure 7:
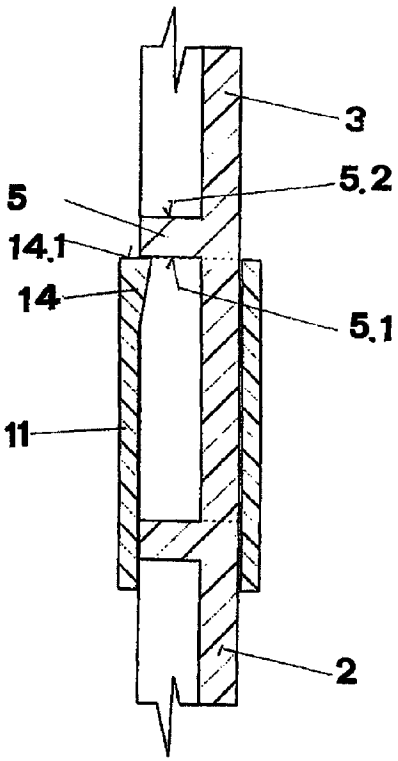
FIG. 7 illustrates a view of the sizer and hanger taken on line VII-VII of FIG. 2.

A tab 5 in the form of an integral protrusion is disposed in the groove 4 at the inclined portion 3.1. The tab 5 extends across the entire width of the channel-shaped groove 4 and is positioned parallel to the body 1 with a lower wall 5.1 and, possibly also an upper wall 5.2 flat (see FIG. 7).

A sizer 10 is fitted onto the hook 2 and blocks itself on the body 1 being kept in position by the tab 5, in a manner described hereafter.

Figure 5:
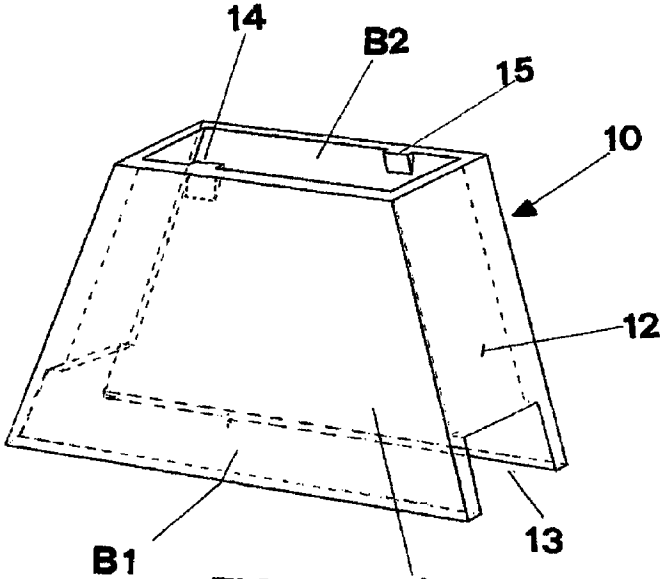
FIG. 5 illustrates a perspective side view of the sizer of FIG. 3.

As can be seen in FIG. 5, the sizer 10 comprises a peripheral wall which defines an open base "B1" in the lower part and a further open base "B2" in the upper part to allow the hook 3 of the hanger 1 to pass inside the sizer 10.

The peripheral wall of the sizer 10 is defined by two preferably trapezium-shaped longitudinal walls 11 and by two rectangle-shaped transverse walls 12, the longitudinal walls 11 having a greater height than the two transverse walls 12, so as to define a recess 13 suitable for receiving the body 2 of the hanger 1 through lock coupling, when the sizer is positioned.

Figure 6:
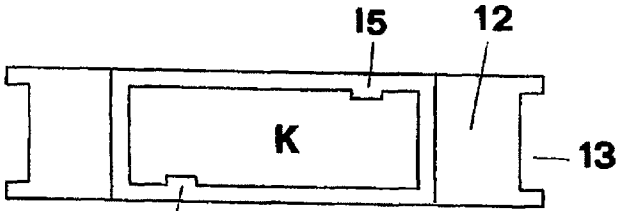
FIG. 6 illustrates a top view of the sizer of FIG. 5.

The sizer 10 is equipped with two protrusion bosses 14 and 15 protruding inside the two longitudinal walls 11 which are in contact with the tab 5 of the hook 2, when the sizer 10 is in position, ensuring, in such a way, that the sizer 10 is blocked onto the hanger. The two protruding bosses 14 and 15 are on the upper part of the two longitudinal walls 11 and are arranged opposite one another and symmetrically with respect to the mid-point "K" (FIG. 6) of the upper opening "B2".

Each of the two bosses 14 and 15 has a profile which is tapered towards the lower base "B1" in order to facilitate the sliding of the sizer 10 over the sides of the hook 3 into the groove 4 as well as over the tab 5 of the hook 2 during the movement towards the body 2 of the sizer 10.

Figure 3:
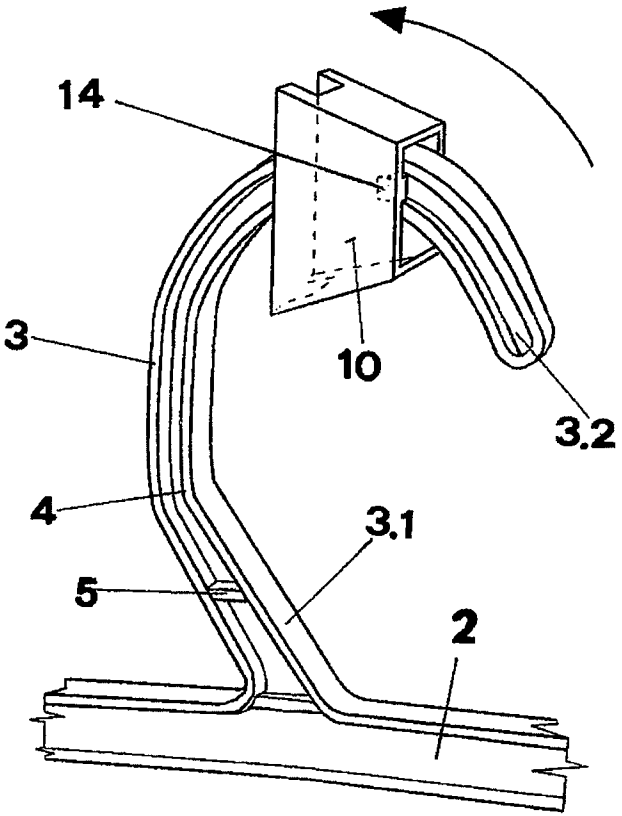
FIG. 3 illustrates a part perspective view of the hanger and sizer of FIG. 1 during sliding of the sizer over the hook of the hanger in accordance with the invention.

In order to mount the sizer 10 onto the hanger 1, the open lower base "B1" of the sizer is positioned above the free tapered part 3.2 (FIG. 3) of the hook 3, which has a thickness which is less than the distance between the projections of the two bosses 14 and 15 of the sizer, which is thus free to move sideways.

Once a boss 14 of the sizer 10 is positioned inside the channel-shaped groove 4 of the hook 3, the sizer 10 is guided by the channel-shaped groove 4.

With the continuous movement along the hook 3, the sizer 10 comes into contact, slides and snaps under the tab 5, which crosses the channel-shaped groove 4. In such a final position, the upper surface 14.1 of the boss 14 of the sizer is positioned below the lower wall 5.1 of the tab 5 of the hook; in such a way the sizer 10 cannot be moved backwards any longer due to the presence of the tab 5, which is in the groove 4 and which blocks any upward movement of the sizer 10.

Figure 4:
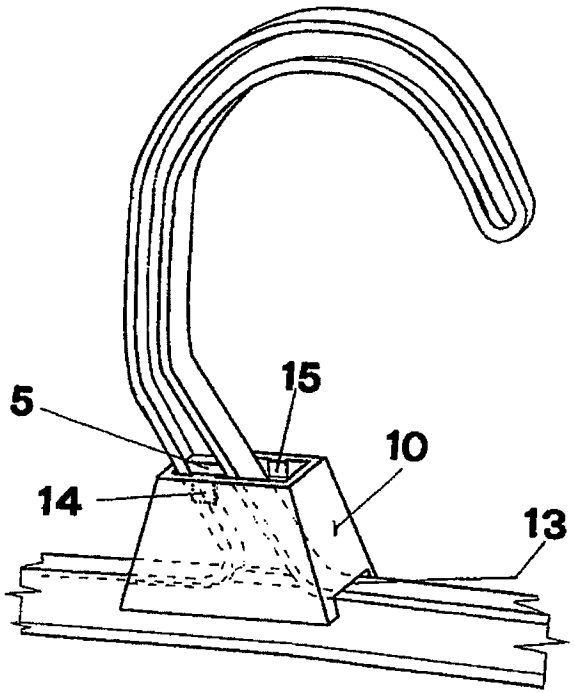
FIG. 4 illustrates a view similar to FIG. 3 with the sizer blocked onto the hook of the hanger in accordance with the invention.

Moreover, when the sizer 10 has been snapped into its location, as indicated in FIG. 4, the body 1 of the hanger is arranged inside the recess 13, i.e., the sizer 10 is locked or mounted "astride" over the body 1 thus impeding any twisting and/or rotation relative to the aforementioned body 1.

Referring to FIGS. 8 to 17, in a second embodiment, the sizer 20 is constructed so as to be slid over the hook 3 of a hanger 1 and then slid laterally into a blocked condition on the hanger.

Figure 8:
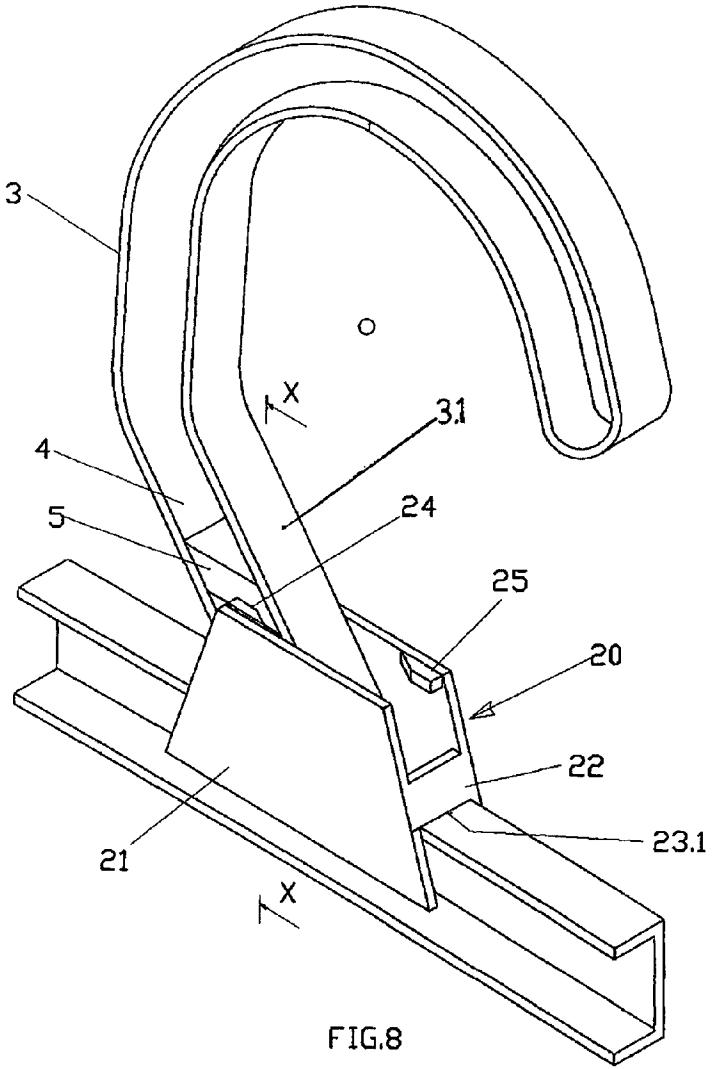
FIG. 8 illustrates a part perspective view of a hook with a second embodiment of a sizer according to the invention.
Figure 14:
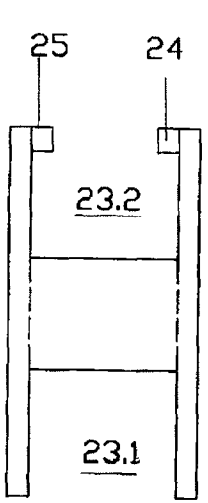
FIG. 14 illustrates a transverse side view of the sizer of FIG. 11.
Figure 13:
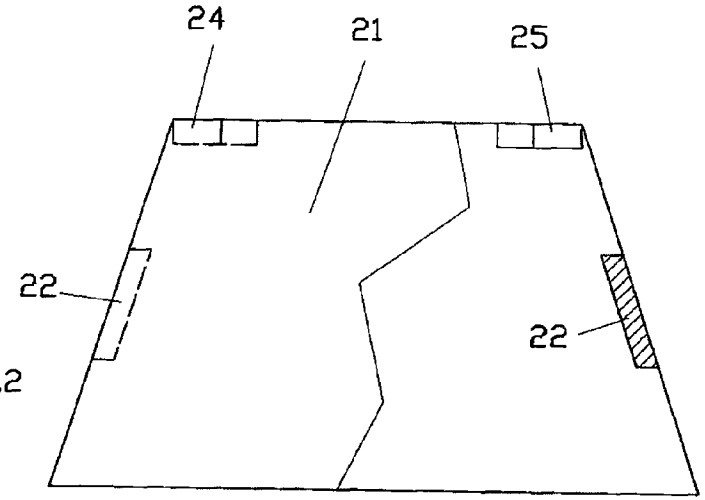
FIG. 13 illustrates a broken longitudinal front side view of the sizer of FIG. 11.

Referring to FIG. 14, the sizer 20 is made up of a peripheral wall defined by two, preferably trapezium-shaped longitudinal walls 21, and two, rectangular-shaped transverse walls 22, the two transverse walls 22 having a shorter height than the two longitudinal walls 21, so as to define a lower recess 23.1, suitable for receiving through lock coupling the body 2, as shown in FIG. 8, and an upper recess 23.2, to allow the inclined portion 3.1 of the hook 3 to come off, as shown in FIG. 8, all whilst the sizer 20 is snapped into position.

Figure 9:
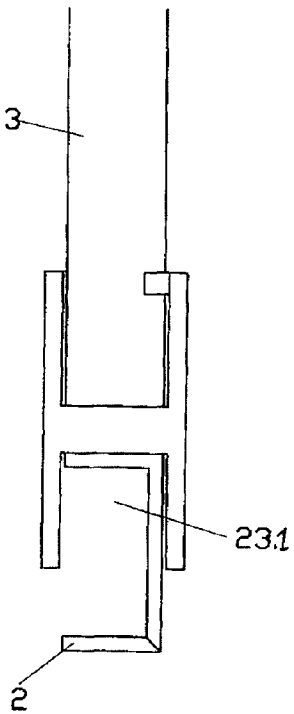
FIG. 9 illustrates a front side view of the sizer and hanger of FIG. 8.
Figure 10:
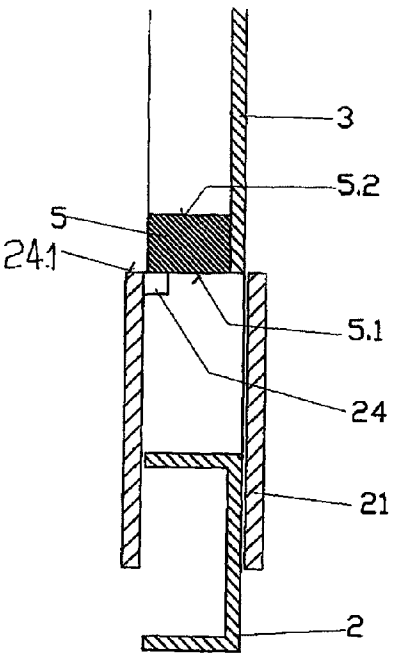
FIG. 10 illustrates a view taken on line X-X of FIG. 8.

Referring to FIGS. 8 to 10, the sizer 20 is equipped with two bosses 24 and 25 protruding inside the two longitudinal walls 21. When the sizer 20 is in position, one or the other of the two protruding bosses 24, 25 is in contact with the underside of the tab 5 of the hook 2, as shown in FIG. 10, ensuring in such a way that the sizer 20 is blocked onto the hanger body 2.

Figure 12:
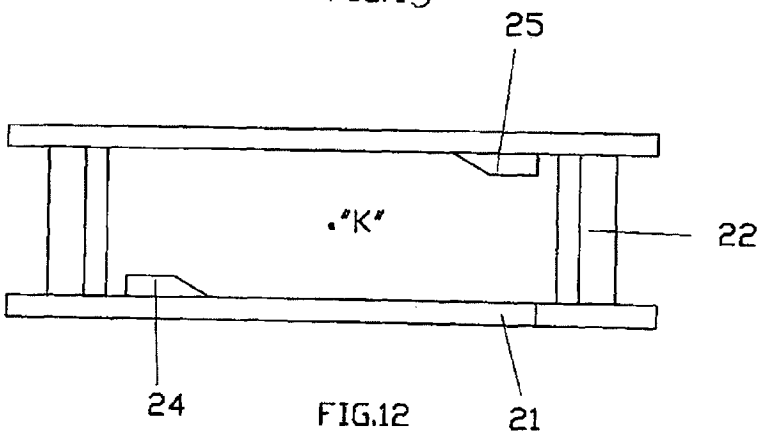
FIG. 12 illustrates a top view of the sizer of FIG. 11.
Figure 11:
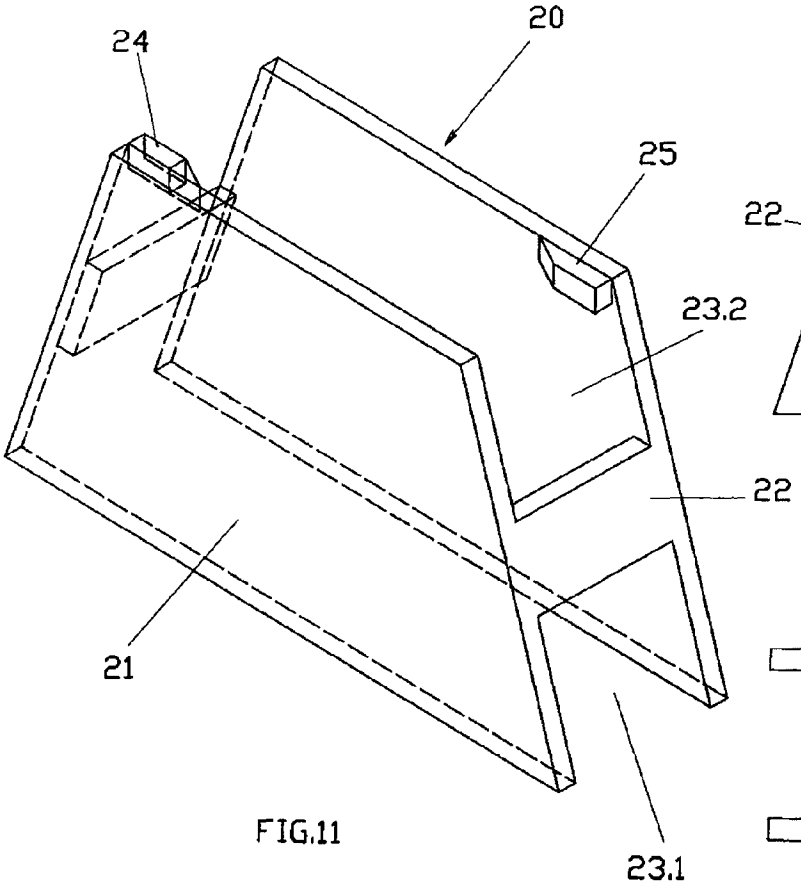
FIG. 11 illustrates a perspective view of the sizer of FIG. 8.

The two protruding bosses 24 and 25 are on the upper part and at the ends of the two longitudinal walls 21 and are arranged opposite one another and symmetrically with respect to the mid-point "K" of the upper opening "B2" (see FIG. 12). As indicated in FIG. 8, the protrusion bosses 24 and 25 are spaced apart at a greater distance than the width of the hook 3 of the hanger so that when the sizer 20 is initially slid over the hook 3, the protrusion bosses 24 and 25 are each disposed outside of the hook as indicated in FIG. 15.

Each of the two bosses 24 and 25 has a profile which is tapered in opposite directions to facilitate the sliding on the side of the hook 3 during the side movement of the sizer 20.

As can be seen in FIGS. 15 to 17, in order to mount the sizer 20 onto the hanger 1, the free end of the hook 3 is fitted onto the sizer, between the two bosses 24 and 25; for such a purpose the inner distance between the two longitudinal walls 21 is slightly greater than the thickness of the hook 3, for which reason the sizer is guided during its sliding along the hook.

With the continuous movement along the hook 3, the sizer 20 comes into contact and locks into the recess 23.1 on the body 1 (FIGS. 16 and 16A) and this prevents any twisting and/or rotation relative to the aforementioned body 1.

With the subsequent horizontal sliding along the body 1, the sizer 20 slides along the hook 2 and snaps into the tab 5, which crosses the channel-shaped groove 4 (FIGS. 17 and 17A). In such a final position, the boss 24 is contained inside the channel-shaped groove 4 and its upper surface is positioned below the lower wall 5.1 of the tab 5 of the hook. In this way, the sizer 10 can no longer slide, due to the presence of the tab 5, which blocks the sizer 20 from above and due to the channel-shaped groove 4, which blocks the sizer 20 sideways.

Figure 18:
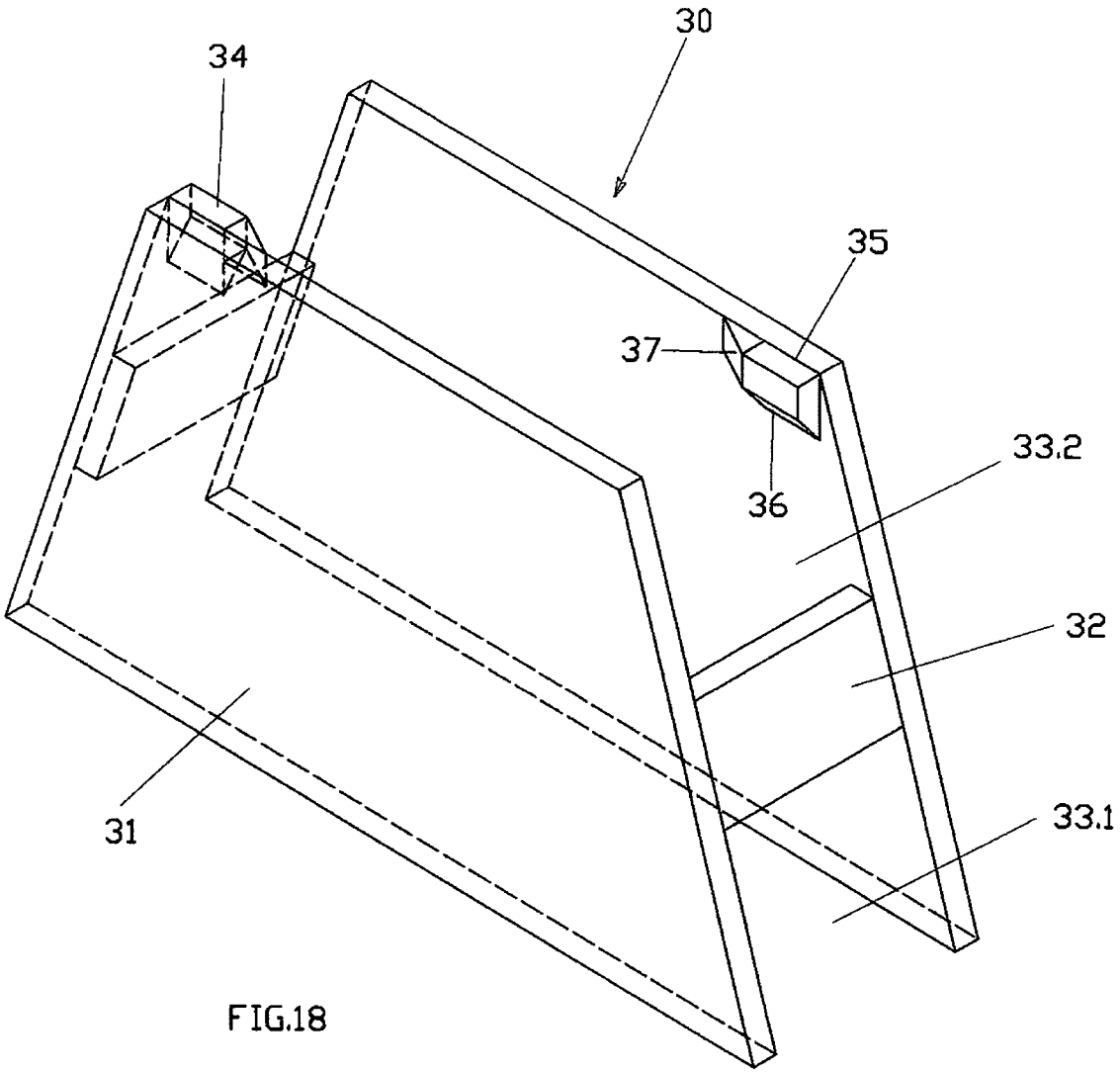
FIG. 18 illustrates a perspective view of a further embodiment of a sizer in accordance with the invention.

Referring to FIG. 18, in another embodiment, the sizer 30 sizer is constructed so as to be slid onto a hook of a hanger and blocked in place as in the first embodiment or to be slid onto a hook of a hanger and laterally moved into place as in the second embodiment.

As illustrated, the sizer 30 is made up of a peripheral wall defined by two, preferably trapezium-shaped longitudinal walls 31 and made up of two, rectangle-shaped transverse walls 32, the transverse walls 32 having a shorter height than the two longitudinal walls 31, so as to define a lower recess 33.1 and an upper recess 33.2. The sizer 30 is also equipped with two bosses 34 and 35 that protrude inside the two longitudinal walls 31 and that have a tapered profile 36 towards the lower base and a further tapered profile 37 with a reciprocally opposite direction to facilitate the sliding of the sizer 30 respectively, over the tab 5 of the hook 2, during movement downward and on the side of the hook 2, during lateral movement.

The invention thus provides a sizer with the preferably trapezium-shaped longitudinal walls 11, 21 or 31 that have a substantial width and therefore provide a surface that allows indicia thereon to show clearly the size of the garment hanging on the hanger.

The sizer 10, 20 or 30 can be made from any suitable material, preferably from plastic material and the thickness of the longitudinal walls 11, 21 and 31, in particular at the bosses 14, 15 and 24, 25 as well as 34, 35 is such as to allow the walls to flex outwards, to allow the bosses to slide over the tab 5 or over the hook 2, respectively, to snap into the channel-shaped groove 4 of the hook.

Moreover, since the sizer 10, 20, 30 has the bosses 14, 15 and 24, 25, as well as 34, 35, opposite each other, the sizer is able to slide above the portion 3.1 of the hook 3 which extends angularly from the body 1, at an angle less than 90.degree. and, can be positioned on a hook in either of the two possible positions for display purposes.

Finally, from what has been described thus far it should be understood that once the sizer 10, 20, 30, has been snapped into its foreseen position, the sizer cannot be easily removed from the hanger. In order to do so, a tool must be inserted inside the sizer, in order to allow the bosses 14, and 24, 25, as well as 34, 35 of the sizer itself to come out of the groove 4 of the hook 2.

The sizer 10, 20, 30 is illustrated and described with respect to a lingerie or underwear hanger; however, the plastic hanger can be of any suitable construction for various types of garments.

The invention further provides a sizer that can easily be mounted on any type of hook or "nail", which extends and takes on its form angularly from any plastic hanger body.

What is claimed is:

1. A combination of a hanger and a sizer, the combination comprising:

the hanger comprising a body, a hook extending from a mid-point of said body, said hook having a lower portion extending upright from said body and a tab protruding on one of two sides of said hook; and the sizer comprising a peripheral wall comprising a first side and a second side opposed to the first side, the peripheral wall defining a lower open base and an open base in an upper part of the sizer for passing over the hook; and a plurality of bosses consisting of at least one boss in a first set and at least one boss in a second set; the first set being disposed on the first side and the second set being disposed on the second side, each of the bosses to engage onto the hanger and block said sizer onto the hanger in a stable manner;

wherein the first set is offset to the second set with respect to a plane bisecting the first and the second side;

wherein said hook has a smooth rear portion coplanar with a rear part of said body and a front part having a channel-shaped groove extending the length of said hook and said body, and wherein said tab extends across the entire width of said groove in parallel to said body, said tab having a flat lower wall in contact with said boss of said sizer to block said sizer onto said hanger.

2. The combination of claim 1, wherein said sizer has a pair of said bosses disposed in spaced relation to each other and on opposite sides of said peripheral wall and wherein said hook is of a width less than the distance between said pair of bosses whereby after sliding of said sizer along said hook with one of said pair of bosses in said groove, said one boss can be slid over said tab to snap under said tab.

3. The combination of claim 1, wherein said sizer has a pair of said bosses disposed in spaced relation to each other and on opposite sides of said peripheral wall and wherein said hook is of a width less than the distance between said pair of bosses whereby after sliding of said sizer along said hook onto said body, said sizer can be slid laterally to snap a selected one of said pair of bosses into said groove and under said tab.

4. The combination of claim 1, wherein the plurality of bosses are disposed at a top of each of the two sides of said peripheral wall to engage onto the hanger.

5. The combination of claim 1, wherein the first set and the second set are arranged opposite one another and symmetrically with respect to a mid-point of said open base in said upper part.

6. The combination of claim 1, wherein each boss has a tapered profile towards said lower open base.

* * * * *